US012366010B2

(12) United States Patent
Udangawa et al.

(10) Patent No.: US 12,366,010 B2
(45) Date of Patent: Jul. 22, 2025

(54) METHOD OF MAKING A MICROFIBER INCLUDING BIOMASS

(71) Applicant: RENSSELAER POLYTECHNIC INSTITUTE, Troy, NY (US)

(72) Inventors: Ranodhi Nilochani Udangawa, Troy, NY (US); Charles Frederick Willard, Cambridge, MA (US); Chiara Diamante Mancinelli, Croton-on-Hudson, NY (US); Caitlyn A. Chapman, Vernon, CT (US); Robert John Linhardt, Albany, NY (US); Trevor John Simmons, Troy, NY (US)

(73) Assignee: RENSSELAER POLYTECHNIC INSTITUTE, Troy, NY (US)

( * ) Notice: Subject to any disclaimer, the term of this patent is extended or adjusted under 35 U.S.C. 154(b) by 186 days.

(21) Appl. No.: 17/729,388

(22) Filed: Apr. 26, 2022

(65) Prior Publication Data

US 2022/0251731 A1 Aug. 11, 2022

Related U.S. Application Data

(63) Continuation of application No. 16/789,914, filed on Feb. 13, 2020, now Pat. No. 11,339,503.
(Continued)

(51) Int. Cl.
*B29C 48/02* (2019.01)
*D01D 5/00* (2006.01)
(Continued)

(52) U.S. Cl.
CPC ..... *D01D 5/0069* (2013.01); *D01D 5/0046* (2013.01); *D01D 5/0076* (2013.01);
(Continued)

(58) Field of Classification Search
CPC ..... D04H 1/43828; D01F 8/02; B29C 48/022
See application file for complete search history.

(56) References Cited

U.S. PATENT DOCUMENTS 5,053,275 A 10/1991 Kagechi et al.
5,153,066 A 10/1992 Tanaka et al.
(Continued)

FOREIGN PATENT DOCUMENTS

CN 101845675 * 9/2010
CN 101845675 A 9/2010
WO 200362513 A2 7/2003

*Primary Examiner* — Edmund H Lee
(74) *Attorney, Agent, or Firm* — Barclay Damon LLP; Anthony P. Gangemi

(57) ABSTRACT

A network of microfibers are fabricated with a core-shell construction from sustainable materials, where the core includes a phase-change material, such as coconut oil, and the shell includes a biomass, such as cellulose. The microfibers are made via a wet-wet electrospinning process utilizing a coaxial spinneret with an inner conduit and an outer conduit. The biomass and the phase-change material are coaxially extruded into a coagulation bath including a mixture of ethanol and water. The collected microfibers exhibit a beaded structure of PCM aggregates and biomass connecting regions between the aggregates and are effective to aid in the thermoregulation of the immediate environment surrounding the network. The microfibers are suitable for use in a variety of sustainable products such as wearable thermoregulating textiles, wall/ceiling panels, insulation, packaging material, and more.

11 Claims, 5 Drawing Sheets

Related U.S. Application Data

(60) Provisional application No. 62/804,837, filed on Feb. 13, 2019.

(51) Int. Cl.

| | |
|---|---|
| ***D01D 5/20*** | (2006.01) |
| ***D01D 5/34*** | (2006.01) |
| ***D01D 10/06*** | (2006.01) |
| ***D01F 1/10*** | (2006.01) |
| ***D01F 2/00*** | (2006.01) |
| ***D04H 1/413*** | (2012.01) |
| ***D04H 1/4382*** | (2012.01) |
| ***D04H 1/4391*** | (2012.01) |
| ***D04H 1/728*** | (2012.01) |

(52) U.S. Cl.

CPC ..... *D01D 5/20* (2013.01); *D01D 5/34* (2013.01); *D01D 10/06* (2013.01); *D01F 1/10* (2013.01); *D01F 2/00* (2013.01); *D04H 1/413* (2013.01); *D04H 1/43828* (2020.05); *D04H 1/43912* (2020.05); *D04H 1/728* (2013.01); *Y10T 442/60* (2015.04); *Y10T 442/614* (2015.04); *Y10T 442/622* (2015.04)

(56) References Cited

U.S. PATENT DOCUMENTS

| | | | | |
|---|---|---|---|---|
| 5,415,222 | A | 5/1995 | Colvin et al. | |
| 6,217,993 | B1 | 4/2001 | Pause | |
| 6,855,410 | B2 | 2/2005 | Buckley | |
| 6,855,422 | B2 | 2/2005 | Magill et al. | |
| 7,241,497 | B2 * | 7/2007 | Magill | D01F 8/04 442/361 |
| 7,244,497 | B2 * | 7/2007 | Hartmann | F28D 20/023 428/401 |
| 8,679,627 | B2 | 3/2014 | Hartmann et al. | |
| 9,605,363 | B2 | 3/2017 | Zhang et al. | |
| 9,725,633 | B2 | 8/2017 | Nihlstrand et al. | |
| 9,797,087 | B2 | 10/2017 | Hartmann et al. | |
| 9,894,944 | B2 | 2/2018 | Brooks et al. | |
| 9,926,653 | B2 | 3/2018 | Allen et al. | |
| 9,963,627 | B2 | 5/2018 | Rajagopalan et al. | |
| 10,151,055 | B2 | 12/2018 | Allen, Jr. et al. | |
| 2002/0000306 | A1 | 1/2002 | Bradley | |
| 2006/0157882 | A1 | 7/2006 | Percec et al. | |
| 2007/0026228 | A1 | 2/2007 | Hartmann et al. | |
| 2007/0089276 | A1 | 4/2007 | Dugan et al. | |
| 2013/0125912 | A1 * | 5/2013 | Tojo | D04H 1/43838 428/398 |
| 2015/0147569 | A1 | 5/2015 | Zhang et al. | |
| 2015/0164117 | A1 | 6/2015 | Kaplan et al. | |
| 2018/0030626 | A1 | 2/2018 | Chen et al. | |

* cited by examiner

METHOD OF MAKING A MICROFIBER INCLUDING BIOMASS

CROSS REFERENCE TO RELATED APPLICATION(S)

This application is a continuation of U.S. Utility Patent Application No. 16/789,914, filed Feb. 13, 2020, now U.S. Pat. No. 11,339,503, which claims the benefit of U.S. Provisional Application No. 62/804,837, filed Feb. 13, 2019, which are incorporated by reference as if disclosed herein in their entireties.

BACKGROUND

Human beings are homeothermic, maintaining a core body temperature of 37° C. through metabolic and physiologic processes. Changes in metabolic rate are generally an efficient thermoregulation mechanism in response to temperature changes in the external environment. According to the standards published by the American Society of Heating, Refrigerating and Air-conditioning Engineers (ASHRAE) in 2010, metabolic rate is defined as the level of transformation of chemical energy into heat and mechanical work by metabolic activities within an organism. Despite this response in metabolic rate, temperature changes in the immediate microclimate of an individual can cause extreme discomfort and stress, particularly in professions that require protective body armor and other bulky clothing, thus, resulting in a decline in work performance. Temperatures between 18 and 21° C. are considered to be the most comfortable temperatures for living rooms and public spaces, respectively.

In cold climates, heating has relied on a variety of fuel sources. In warmer climates, in the last century, air conditioning has been used to achieve this comfort level at a cost of electric and fossil fuel energy. The residential, commercial and industrial use of air conditioning is notably rising due to the increasing population and global warming. According to the US Department of Energy, roughly 117 million metric tons of carbon dioxide is released into the air each year as a result of increasing air conditioning usage. This could further accelerate the adverse effects on the environment, thus causing climate change. Hence, the concept of creating wearable materials that can regulate body temperature has drawn increased attention of researchers over the past few decades.

Phase changing materials (PCMs) have been used to produce smart textiles since the 1980's to regulate temperature of the wearer. PCMs have the capability to store and release latent heat energy as they undergo phase changes while keeping their temperature constant. Initially, inorganic salt hydrates were mixed into textile fibers such as rayon to modify the heat capacities of the fibers to impart thermoregulating properties. Use of salts were subsequently replaced with polymeric materials to produce more durable composite fibers.

Several types of polymeric nanocomposite fibers have been fabricated by electrospinning, in which one polymer is used as the matrix and the other functions as a PCM. Electrospinning is a fiber fabrication technique that was invented nearly a century ago. Conventional electrospinning involves dissolution of the desired polymer in a volatile solvent that evaporates in the electrospinning process leaving dry polymeric fibers on a solid collector, commonly known as wet-dry electrospinning. Electrospinning complex polysaccharides, such as cellulose, is challenging due to the insolubility of cellulose in water or most volatile organic solvents. Cellulose, a linear polysaccharide with an extensive hydrogen-bonding network, possesses excellent thermal and mechanical properties allowing it to form fibers with high tensile strength. While its strong intra and intermolecular hydrogen-bonding prevents the dissolution of cellulose in conventional solvents, a class of non-volatile, hydrogen-bond-breaking solvents known commonly as room temperature ionic liquids (RTILs) readily dissolve cellulose and can be used in electrospinning. RTIL-dissolved cellulose can be electrospun into a coagulation bath filled with water, a non-solvent that is miscible with the RTIL but which does not dissolve cellulose. This process is referred to as wet-wet electrospinning.

SUMMARY

Accordingly, some embodiments of the present disclosure relate to a method of making a microfiber including biomass including providing a coaxial spinneret having an inner conduit and an outer conduit, providing a grounded coagulation bath opposite the coaxial spinneret, the coagulation bath including one or more solvents, providing a source of biomass in communication with the outer conduit, providing a source of a phase-change material (PCM) in communication with the inner conduit, applying a voltage between the spinneret and the coagulation bath, co-axially extruding the biomass and the PCM through the spinneret to electrospin a microfiber having a biomass shell and a PCM core, and collecting the microfiber at the coagulation bath. In some embodiments, the method includes drying the microfiber via freeze-drying, air drying, or combinations thereof. In some embodiments, the fibers include a beaded structure of PCM aggregates and biomass connecting regions between the aggregates. In some embodiments, the core has a melting temperature between about 20° C. and 25° C. In some embodiments, the one or more solvents includes ethanol, water, or combinations thereof. In some embodiments, the biomass includes cellulose. In some embodiments, the PCM includes coconut oil, paraffin wax, fatty acids, polyethylene glycol, salt hydrates, or combinations thereof. In some embodiments, the biomass is extruded at a rate of about 10 μL/min and the PCM is extruded at a rate of about 80 μL/min.

Some embodiments of the present disclosure are directed to a microfiber material including a fiber network including one or more electrospun microfibers. In some embodiments, the microfibers include a shell including a biomass and a core confined within the shell, wherein the core includes a PCM, wherein the microfibers include a beaded structure of PCM aggregates and biomass connecting regions between the aggregates. In some embodiments, the core has a melting temperature between about 20° C. and 25° C. In some embodiments, the biomass includes cellulose. In some embodiments, the PCM includes coconut oil, paraffin wax, fatty acids, polyethylene glycol, salt hydrates, or combinations thereof. In some embodiments, the microfibers are prepared by an electrospinning process including the steps of: providing a coaxial spinneret having an inner conduit and an outer conduit; providing a grounded coagulation bath opposite the coaxial spinneret, the coagulation bath including one or more solvents; providing a source of biomass in communication with the outer conduit; providing a source of a PCM in communication with the inner conduit; applying a voltage between the spinneret and the coagulation bath; co-axially extruding the biomass and the PCM through the spinneret to electrospin a microfiber having a biomass shell and a PCM core; and collecting the microfiber at the coagulation bath. In some embodiments, the beaded structure has a diameter of between about 4 μm and about 12 μm and the connecting regions have a diameter of between about 2 μm and about 4 μm.

Some embodiments of the present disclosure are directed to a system for producing a microfiber including biomass including a coaxial spinneret having an inner conduit and an outer conduit, a grounded coagulation bath opposite the coaxial spinneret, the coagulation bath including one or more solvents, a source of biomass in communication with the outer conduit, a source of a PCM in communication with the inner conduit, and a potentiostat positioned to provide a voltage between the spinneret and the coagulation bath. In some embodiments, the inner conduit has a first flow diameter and the outer conduit has a second flow diameter, wherein the ratio of the first flow diameter to the second flow diameter is about 0.25. In some embodiments, the spinneret is separated from the coagulation bath by about 13 cm. In some embodiments, the one or more solvents includes ethanol, water, or combinations thereof. In some embodiments, the biomass includes cellulose. In some embodiments, the PCM includes coconut oil, paraffin wax, fatty acids, polyethylene glycol, salt hydrates, or combinations thereof.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Figure 1:
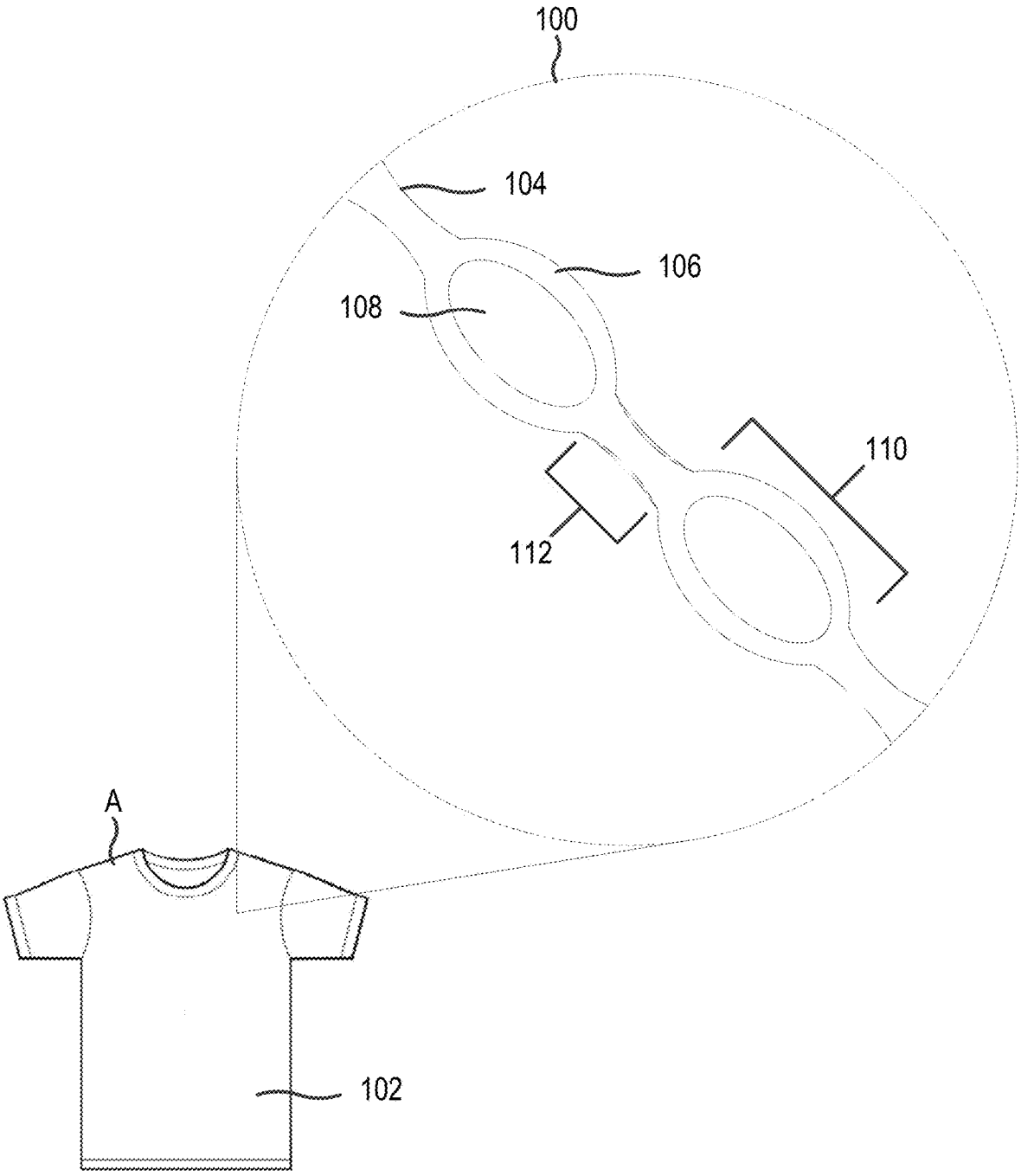
FIG. 1 is a schematic representation of a microfiber material according to some embodiments of the present disclosure.

Referring now to FIG. 1, some embodiments of the present disclosure are directed to a microfiber material 100 for providing thermoregulating properties to an article A. In some embodiments, material 100 includes a fiber network 102 that includes one or more microfibers 104. In some embodiments, microfibers 104 in network 102 are cross-linked. In some embodiments, microfibers 104 are formed by an electrospinning process, as discussed in greater detail below. In some embodiments, the electrospinning process is a wet-wet electrospinning process.

In some embodiments, microfibers 104 include a shell 106 and a core 108 confined within the shell. In some embodiments, shell 106 includes a biomass. In some embodiments, the biomass includes cellulose. In some embodiments, shell 106 includes additional materials to make it stronger and/or more flexible. In some embodiments, core 108 includes one or more phase-change materials (PCM). In some embodiments, the PCM includes coconut oil, paraffin wax, fatty acids, polyethylene glycol, salt hydrates, or combinations thereof. In some embodiments, microfibers 104 include a beaded structure of core aggregates 110 and connecting regions 112 between the aggregates. In some embodiments, aggregates 110 include PCM. In some embodiments, aggregates include a greater percentage of PCM than biomass. In some embodiments, aggregates 110 are composed substantially of PCM. In some embodiments, connecting regions 112 include a biomass. In some embodiments, connecting regions 112 include a greater percentage of biomass than PCM. In some embodiments, connecting regions 112 are composed substantially of a biomass. In some embodiments, aggregates 110 have a diameter of between about 4 μm and about 12 μm. In some embodiments, aggregates 110 have a diameter of about 8 μm. In some embodiments, connecting regions 112 have a diameter of about 2 μm and about 4 μm. In some embodiments, connecting regions 112 have a diameter of about 3 μm. In some embodiments, core 108 has a melting temperature between about 20° C. and 25° C. In some embodiments, microfibers 104 include about 65% to about 85% by weight biomass. In some embodiments, microfibers 104 include about 75% by weight biomass.

Without wishing to be bound by theory, the PCM in the microfibers regulates the temperature of environment immediately surrounding the fiber network. When the surrounding temperature is warm, i.e., above its melting point, the PCM absorbs heat and melts. When the surrounding temperature is cold, i.e., below its melting point, the PCM releases heat by crystallizing inside the fiber. The biomass acts as a solid hydrophilic shell to hold the PCM core in place. In some embodiments, article A includes wearable textiles, wall/ceiling panels, insulation, packaging material, etc.

Figure 2:
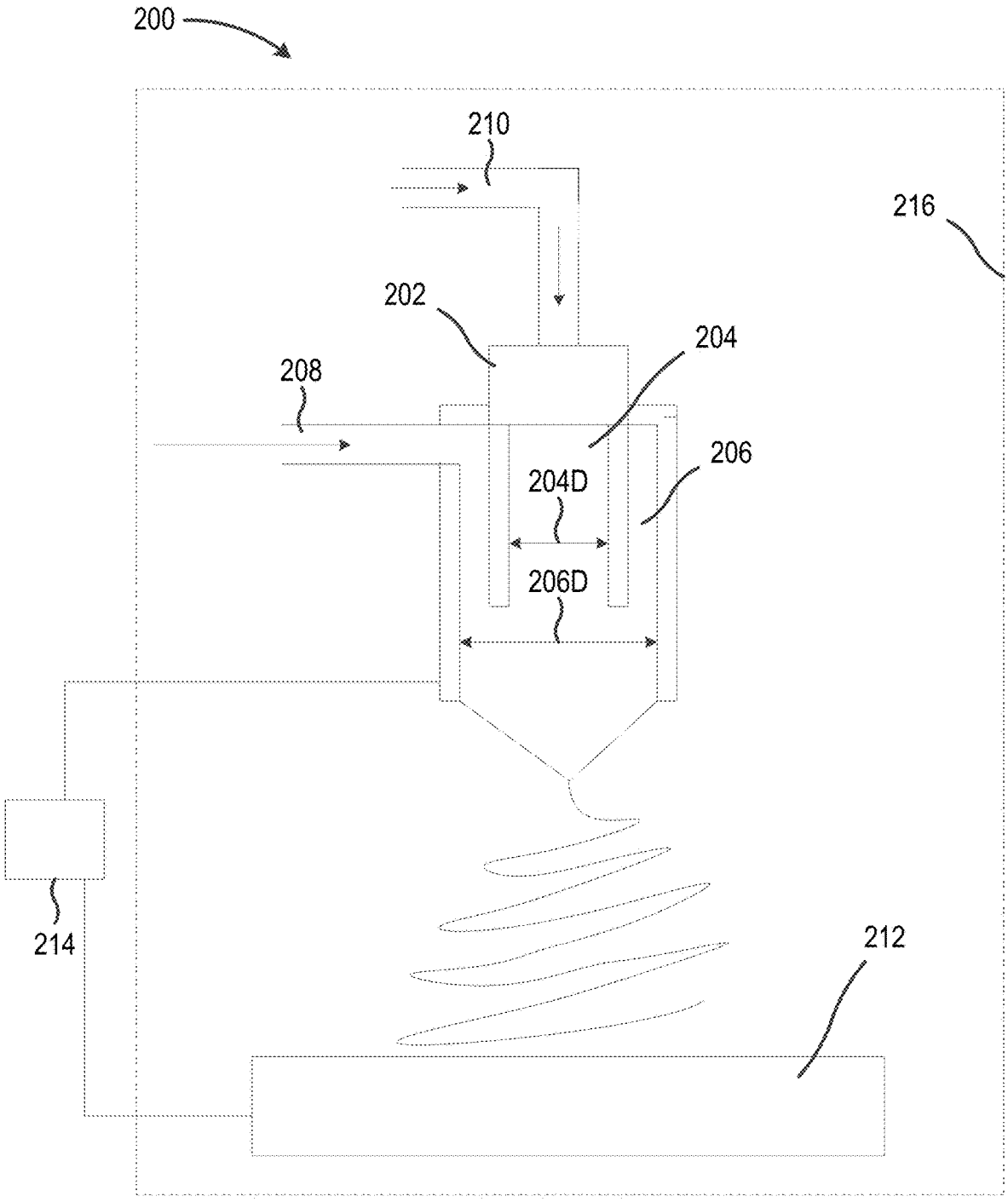
FIG. 2 is a schematic representation of a system for producing a microfiber according to some embodiments of the present disclosure.

Referring now to FIG. 2, some embodiments of the present disclosure are directed to a system 200 for producing a microfiber including biomass. In some embodiments, system 200 is an electrospinning system. In some embodiments, system 200 is configured for wet-wet electrospinning. In some embodiments, system 200 includes one or more spinnerets 202. In some embodiments, spinneret 202 includes a plurality of flow conduits. The flow conduits are configured to convey one or more materials to a tip of spinneret 202 for electrospinning of those materials. In some embodiments, the plurality of flow conduits are coaxial. In some embodiments, spinneret 202 includes an inner conduit 204 and an outer conduit 206. In some embodiments, inner conduit 204 has a first flow diameter 204D. In some embodiments, outer conduit 206 has a second flow diameter 206D. In some embodiments, the ratio of the first flow diameter 204D to second flow diameter 206D is between about 0.2 and about 0.3. In some embodiments, the ratio of the first flow diameter 204D to second flow diameter 206D is about 0.25.

In some embodiments, system 200 includes a source 208 of biomass in communication with outer conduit 206. In some embodiments, source 208 of biomass also includes room temperature ionic liquids (RTIL) to aid dissolution of the biomass. In some embodiments, the RTIL includes 1-ethyl-3-methylimidazoliumacetate. In some embodiments, source 208 of biomass includes about 1% w/v to about 2% w/v biomass. In some embodiments, source 208 of biomass includes about 1.5% w/v biomass. In some embodiments, the biomass includes cellulose.

In some embodiments, system 200 includes a source 210 of a phase-change material (PCM) in communication with inner conduit 204. In some embodiments, the PCM includes coconut oil, paraffin wax, fatty acids, polyethylene glycol, salt hydrates, or combinations thereof.

In some embodiments, system 200 includes a grounded coagulation bath 212 opposite spinneret 202. In some embodiments, spinneret 202 is separated from coagulation bath 212 by above about 10 cm. In some embodiments, spinneret 202 is separated from coagulation bath 212 by below about 15 cm. In some embodiments, spinneret 202 is separated from coagulation bath 212 by about 13 cm. In some embodiments, coagulation bath 212 includes one or more solvents. In some embodiments, the one or more solvents includes ethanol, water, or combinations thereof.

In some embodiment, system 200 includes a potentiostat 214. Potentiostat 214 is positioned to provide a voltage between spinneret 202 and coagulation bath 212. In some embodiments, components of system 200 are included within an anti-static container 216, e.g., an anti-static box. In some embodiments, anti-static container 216 is composed of one or more polymeric materials, e.g., polycarbonate. Anti-static container 216 is used to isolate the electrospinning process from interference from static charges and other intrusions, e.g., the draft of a fume hood. In some embodiments, ventilation windows are incorporated to accommodate solvent evaporation thereby keeping the humidity inside the box substantially constant.

Figure 3:
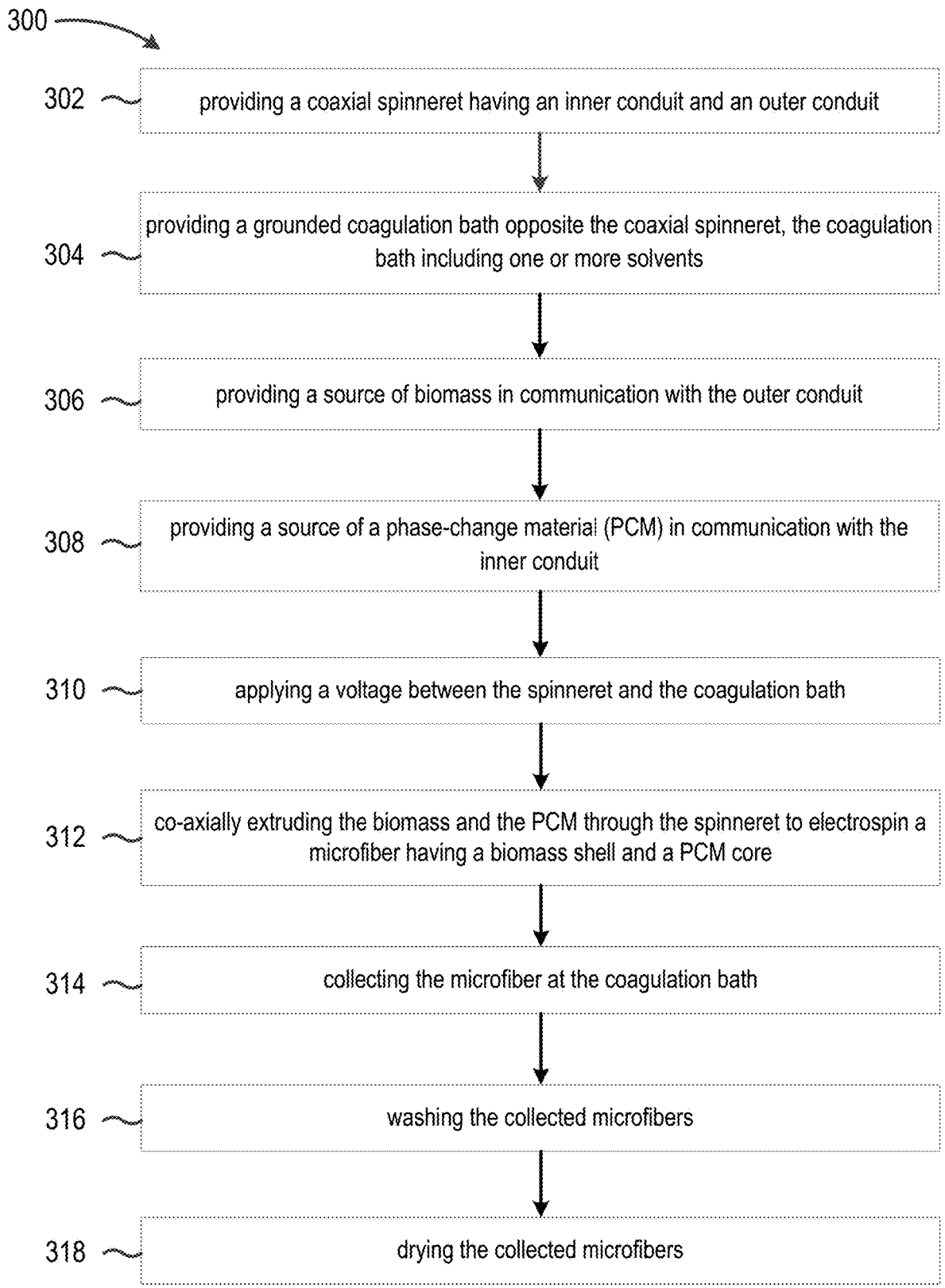
FIG. 3 is a chart of a method of making a microfiber according to some embodiments of the present disclosure.
Figure 4A:
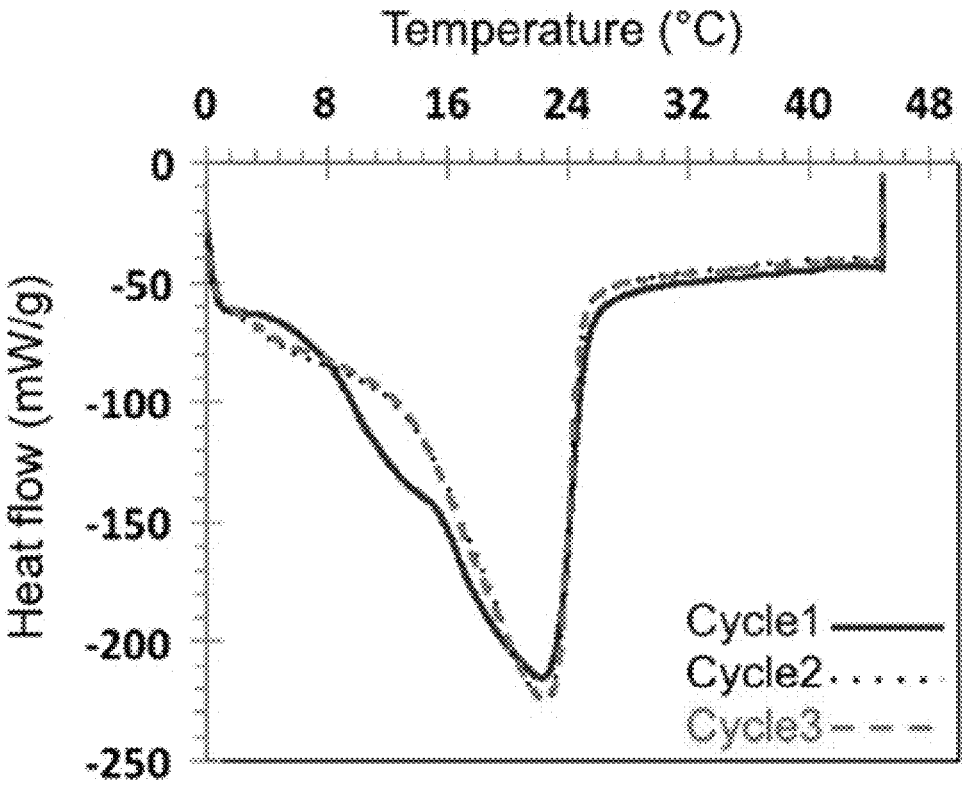
FIGS. 4A-4B are graphs of differential scanning calorimetry analysis performed for microfibers according to some embodiments of the present disclosure.
Figure 4B:
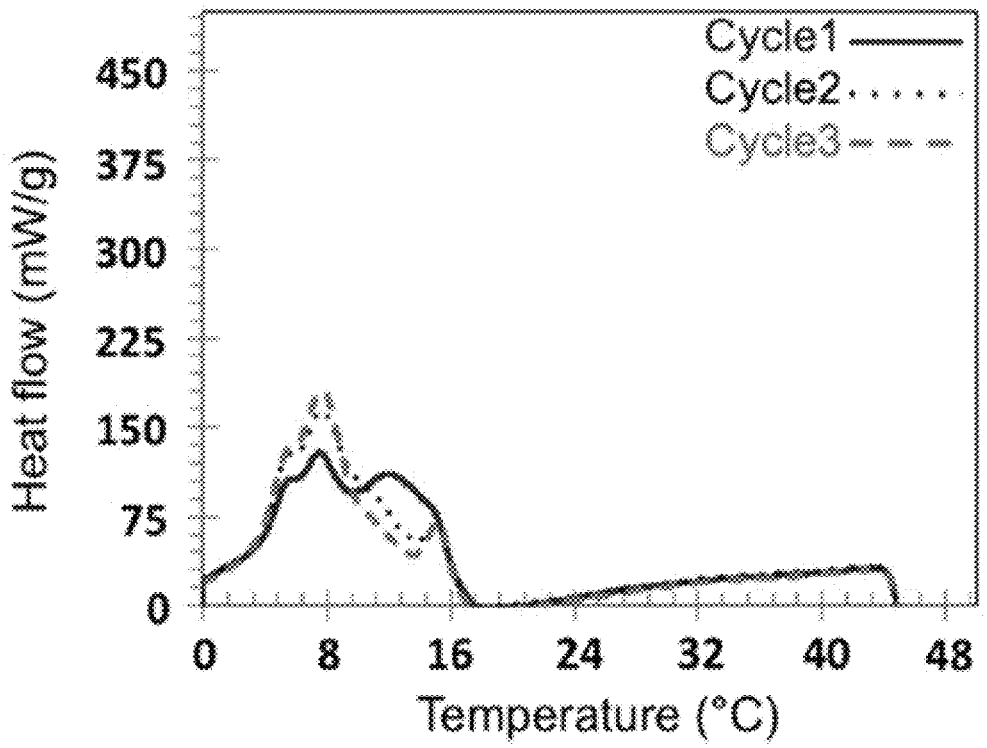

Referring now to FIG. 3, some embodiments of the present disclosure are directed to a method 300 of making a microfiber including biomass. In some embodiments, at 302 a coaxial spinneret having an inner conduit and an outer conduit is provided. At 304, a grounded coagulation bath is provided opposite the coaxial spinneret. As discussed above, in some embodiments, the coagulation bath includes one or more solvents, e.g., ethanol, water, or combinations thereof. At 306, a source of biomass is provided in communication with the outer conduit. In some embodiments, the biomass includes cellulose. At 308, a source of a PCM is provided in communication with the inner conduit. In some embodiments, the PCM includes coconut oil, paraffin wax, fatty acids, polyethylene glycol, salt hydrates, or combinations thereof. At 310, a voltage is applied between the spinneret and the coagulation bath. At 312, the biomass and the PCM are co-axially extruded through the spinneret to electrospin a microfiber having a biomass shell and a PCM core. In some embodiments, the biomass and the PCM are co-extruded at a rate of about 10 μL/min to about 80 μL/min. In some embodiments, the biomass and the PCM are co-extruded at a rate of about 40 μL/min. In some embodiments, the biomass is extruded at a rate of about 10 μL/min. In some embodiments, the PCM is extruded at a rate of about 80 μL/min. In some embodiments, the microfiber is electrospun in a wet-wet electrospinning process. Without wishing to be bound by theory, in wet-wet- electrospinning embodiments, the biomass-PCM fiber jet traversing the space between the spinneret and the coagulation bath forms an intermediate hydrogel upon entering the coagulation bath. This hydrogel state is formed due to the migration of RTIL into the water bath in exchange for water molecules. This process enables efficient removal of ionic liquid from the fiber. At 314, the microfiber is collected at the coagulation bath. In some embodiments, at 316, the collected microfiber is washed one or more times with distilled water and water/ethanol mixture under suction filtration to remove residual ionic liquid and other possible contaminants. During washing step 316, fibers swell, removing ionic liquid. At 318, the microfiber is dried via freeze-drying, air drying, or combinations thereof Referring now to FIGS. 4A-4B, differential scanning calorimetry (DSC) analysis was used to determine the phase transition properties of PCM-biomass core-shell fibers. Three different endotherms (FIG. 4A) and exotherms (FIG. 4B) were obtained by subjecting the samples to three consecutive heating and cooling cycles between 0 and 45° C. DSC thermograms of cellulose showed no peaks for both heating and cooling cycles.

EXAMPLE

Bleached high-pure sulfite spruce (softwood) cellulose pulp (SFI) with 95% α-cellulose content and 2% alkali-soluble content (degree of cellulose polymerization approx. 1100) was obtained from Weyerhaeuser Co. (2449 Stagecoach Rd, Oglethorpe, Ga. 31068 U.S.A). The RTIL 1-ethyl-3-methylimidazolium acetate ([EMIM][Ac]), absolute ethanol (>99.8%) and analytical grade coconut oil were obtained from Sigma-Aldrich (St. Louis, Mo., U.S.A). Double-distilled water (ddH2O) was used for all the electrospinning experiments and subsequent washing steps.

Cellulose pulp was dissolved in [EMIM][Ac] by mechanical stirring at 80° C. to prepare a 1.5% (w/v) homogenous cellulose solution. Solidified coconut oil was melted by heating at 100° C. for 5 min.

A wet-wet electrospinning technique was used to construct the microfibers. All the electrospinning experiments were conducted inside an anti-static polycarbonate box. The entire electrospinning process was carried out in this box within a standard laboratory fume hood. All the experiments were carried out at 20±3° C. with a relative humidity of 48±5%. The temperature and the relative humidity were measured using a digital humidity and temperature monitor (AcuRite®). The initial electrospinning parameters were selected from the following ranges: concentration of cellulose from 1.5 to 2 w/v% voltages from 15 to 20 kV cellulose flow rate of 40 μL/min; and distance of 9 cm. The initial parameters were then optimized for this particular study to be: 1.5 w/v% concentration of cellulose; 18 kV voltage; 80 μL/min flow rate of cellulose; 10 μL/min flow rate of coconut oil; and 12.7 cm distance between the tip of the needle and the surface of the coagulation bath.

The coconut oil-cellulose core-shell microfibers were fabricated using a coaxial electrospinning technique. A co-axial spinneret (MECC, Ogori, Fukuoka, Japan) was fitted with a blunt tip aluminum needle (23 Gauge) that has an internal diameter of 0.635 mm. The diameter of the outer needle was 2.50 mm. The 1.5% (w/v) cellulose solution (shell solution) and melted coconut oil (core solution) were placed in two separate 10 mL Norm-Ject syringes and connected to the spinneret using polytetrafluoroethylene (PTFE) tubing. A syringe heater kit (HEATER-KIT-1, New Era Pump System Inc., Wantagh, N.Y., U.S.A) was used to keep the melted coconut oil at a constant temperature of 80° C. A high-voltage of 18 kV was applied between the spinneret (positive) and the electrically grounded collector (negative) using a high voltage supply (CZE1000R, Spellman, Hauppauge, N.Y., U.S.A) that is capable of generating a DC voltage up to 30 kV. The collector was a coagulation bath filled with 50% ethanol-water mixture with a small sheet of aluminum foil on the bottom. Electrospun fibers were collected after the removal of the [EMIM][Ac] in the coagulation bath, which coagulated and solidified the fibers. Two syringe pumps (NE-1000, New Era Pump System Inc., Wantagh, N.Y., U.S.A.) were used to feed the core and shell polymer solutions at constant rates of 10 μL/min and 80 μL/min, respectively, to obtain continuous core-shell composite fibers. Finally, the fibers were washed several times with distilled and deionized water, and freeze-dried to obtain the final coconut oil-cellulose core-shell composite fiber balls.

Methods and systems of the present disclosure provide networks of fibers that can aid in the thermoregulation of the immediate environment surrounding the network to increase comfortability and reduce the need for air conditioning, heating, etc. The composite phase change fiber material could be used for a variety of sustainable products such as wearable thermoregulating textiles, wall/ceiling panels, insulation, and packaging material. Furthermore, this material has the capability to store relatively large amounts of heat over a narrow temperature range without a noticeable volume change while maintaining the temperature of the immediate environment below 22° C. and above 7° C. The advantage of using this material over commercially available alternatives such as textile yarns injected with microencapsulated phase change material (Thermocules®, Outlast Technologies) is that it is inexpensive, environmentally friendly, and likely more durable. The fibers themselves are sustainable in that the components are highly abundant and available in many parts of the world. The sources of these materials can be easily replenished and therefore are a sustainable option.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

What is claimed is:

1. A method of making a microfiber including biomass, the method comprising:

providing a coaxial spinneret having an inner conduit and an outer conduit;

providing a grounded coagulation bath opposite the coaxial spinneret, the coagulation bath including one or more solvents;

providing a source of biomass in communication with the outer conduit;

providing a source of a phase-change material (PCM) in communication with the inner conduit;

applying a voltage between the spinneret and the coagulation bath;

co-axially extruding the biomass and the PCM through the spinneret to electrospin a microfiber comprising:

a plurality of aggregates that each define a first diameter between about 4 μm and about 12 μm and include a biomass shell confining a PCM core; and a plurality of connecting regions that each connect adjacent aggregates and define a second diameter that is less than the first diameter; and collecting the microfiber at the coagulation bath.

2. The method according to claim 1, further comprising drying the microfiber via freeze-drying, air drying, or combinations thereof.

3. The method according to claim 1, wherein the inner conduit defines a first flow diameter and the outer conduit defines a second flow diameter, and wherein a ratio of the first flow diameter to the second flow diameter is between about 0.2 and about 0.3.

4. The method according to claim 3, wherein the core has a melting temperature between about 20° C. and 25° C.

5. The method according to claim 1, wherein the one or more solvents includes ethanol, water, or combinations thereof.

6. The method according to claim 1, wherein the biomass includes cellulose.

7. The method according to claim 1, wherein the PCM includes coconut oil, paraffin wax, fatty acids, polyethylene glycol, salt hydrates, or combinations thereof.

8. The method according to claim 1, wherein the biomass is extruded at a rate of about 10 μL/min and the PCM is extruded at a rate of about 80 μL/min.

9. The method according to claim 1, further comprising structuring an anti-static housing to contain the coaxial spinneret and coagulation bath.

10. The method according to claim 1, wherein the second diameter is between about 2 μm and about 4 μm.

11. The method according to claim 1, further comprising electrospinning the plurality of connecting regions to comprise a greater percentage of biomass than PCM.

* * * * *